US007909189B2

(12) United States Patent
Ours et al.

(10) Patent No.: US 7,909,189 B2
(45) Date of Patent: Mar. 22, 2011

(54) BULK TRANSPORT SYSTEM FOR DENSE PRODUCTS

(75) Inventors: David C. Ours, Marshall, MI (US); Randall L. Cary, Battle Creek, MI (US); Gary W. Gunia, Portage, MI (US)

(73) Assignee: Kellogg Company, Battle Creek, MI (US)

( * ) Notice: Subject to any disclaimer, the term of this patent is extended or adjusted under 35 U.S.C. 154(b) by 827 days.

(21) Appl. No.: 11/356,253

(22) Filed: Feb. 16, 2006

(65) Prior Publication Data

US 2006/0191927 A1 Aug. 31, 2006

Related U.S. Application Data

(60) Provisional application No. 60/654,301, filed on Feb. 18, 2005.

(51) Int. Cl.
*B65D 6/00* (2006.01)

(52) U.S. Cl. ..... 220/4.21

(58) Field of Classification Search ..... 220/1.6, 220/495.06, 4.29, FOR. 128, 495.01, 4.01, 220/FOR. 127, FOR. 120, 8; 229/117.35, 229/117.27, 122.28, 122.27, 122.23, 122.34, 229/100, 122.21, 122.32, 163, 173, 172, 229/165; D9/414

See application file for complete search history.

(56) References Cited

U.S. PATENT DOCUMENTS

| | | | | |
|---|---|---|---|---|
| 655,939 | A * | 8/1900 | Overton | 229/101 |
| 690,575 | A * | 1/1902 | Herre | 229/145 |
| 959,261 | A * | 5/1910 | Reber | 229/122.34 |
| 1,357,519 | A * | 11/1920 | Russell | 229/125.32 |
| 1,414,236 | A * | 4/1922 | Walmsley | 229/104 |
| 1,957,264 | A * | 5/1934 | Gross | 229/145 |
| 2,391,639 | A * | 12/1945 | Meller | 206/521.1 |
| 2,497,455 | A * | 2/1950 | Johnson | 229/122 |
| 3,054,549 | A * | 9/1962 | Humphrey | 229/117.3 |
| 3,157,346 | A * | 11/1964 | Hamilton | 206/512 |
| 3,204,853 | A * | 9/1965 | Hoyne et al. | 206/454 |
| 3,266,707 | A * | 8/1966 | Aust et al. | 229/185 |
| 3,317,112 | A * | 5/1967 | Futterman | 229/129.1 |
| 3,539,360 | A * | 11/1970 | Wood | 426/124 |
| 4,011,983 | A * | 3/1977 | Greene | 229/104 |
| 4,174,051 | A * | 11/1979 | Edwards et al. | 222/105 |
| 4,341,337 | A | 7/1982 | Beach, Jr. et al. | |
| 4,361,236 | A * | 11/1982 | Lavery | 229/227 |
| 4,362,265 | A * | 12/1982 | Williams | 229/125.19 |
| 4,465,227 | A * | 8/1984 | Hood et al. | 229/135 |

(Continued)

FOREIGN PATENT DOCUMENTS

GB 2248055 A * 3/1992

*Primary Examiner* — Anthony Stashick
*Assistant Examiner* — Robert J Hicks
(74) *Attorney, Agent, or Firm* — Dickinson Wright PLLC

(57) ABSTRACT

A bulk packaging support structure for supporting a radially flexible container during filling includes first and second foldable members each having a bottom portion and a side portion. The side portion includes a first wall section that is pivotally connected to the bottom portion along a primary fold line. The side portion further includes a second wall section that is pivotally connected to the first wall section along a secondary fold line that extends perpendicular to the primary fold line. The first and second foldable members are releasibly engaged with one another such that the bottom portion of the first foldable member is disposed between the second wall section and the bottom portion of the second foldable member.

20 Claims, 2 Drawing Sheets

U.S. PATENT DOCUMENTS 4,477,015 A 10/1984 Lozaun
4,854,474 A * 8/1989 Murray et al. ..... 220/1.5
4,976,374 A 12/1990 Macaluso
5,069,359 A 12/1991 Liebel
5,156,295 A * 10/1992 Gordon et al. ..... 229/117.35
5,192,019 A * 3/1993 Meehan ..... 229/101
5,215,248 A 6/1993 Moser
5,314,088 A * 5/1994 Heuberger et al. ..... 229/117.3
5,356,014 A 10/1994 Berner
5,358,174 A 10/1994 Antczak et al.
5,544,472 A 8/1996 Koskinen et al.
6,012,266 A 1/2000 Koskinen et al.
6,062,431 A * 5/2000 Geshay ..... 222/105
6,205,750 B1 3/2001 Koskinen et al.
6,253,993 B1 * 7/2001 Lloyd et al. ..... 229/117.3
6,457,636 B1 10/2002 Van de Ven et al.
6,594,970 B1 7/2003 Hyne et al.
RE38,377 E * 1/2004 Geshay ..... 222/105
6,932,266 B2 8/2005 Jones et al.
6,955,290 B2 10/2005 Wende
2004/0188504 A1 * 9/2004 Pierce ..... 229/109
2005/0029336 A1 * 2/2005 Wende ..... 229/129.1

* cited by examiner

BULK TRANSPORT SYSTEM FOR DENSE PRODUCTS

CROSS-REFERENCE TO RELATED APPLICATIONS

This application claims the benefit of U.S. Provisional Patent Application Ser. No. 60/654,301 for a BULK TRANSPORT SYSTEM FOR DENSE PRODUCTS, filed on Feb. 18, 2005, which is hereby incorporated by reference in its entirety.

BACKGROUND OF THE INVENTION

1. Field of the Invention

The invention relates to a packaging system for products and more particularly to a container formed from a pair of foldable members.

2. Description of the Related Art

Reusable containers for products that are shipped in bulk are usually very sturdy for at least two reasons. First, reusable bulk containers will often hold a large quantity of product. Also, reusable bulk containers must be amenable to return transit back to the point of origination without damage. Based on these operating conditions, reusable bulk containers will often be heavy, expensive and difficult to collect and store when not in use. Many empty bulk containers are damaged or lost during transit back to the point of origination.

SUMMARY OF THE INVENTION

The invention provides a method for filling a container with one of a plurality of particles and a liquid. The method includes the step of filling a radially flexible container through a large diameter with one of a plurality of particles and a liquid to a fill level. The method also includes the step of reducing the large diameter of the radially flexible container to a smaller fill diameter in vertical relationship to the fill level as the fill level rises during filling of the flexible container. The method also includes the step of placing a paperboard structure on opposing sides of the radially flexible container to support the radially flexible container during filling.

Other applications of the present invention will become apparent to those skilled in the art when the following description of the best mode contemplated for practicing the invention is read in conjunction with the accompanying drawings.

DETAILED DESCRIPTION OF A PREFERRED EMBODIMENT

Figure 1:
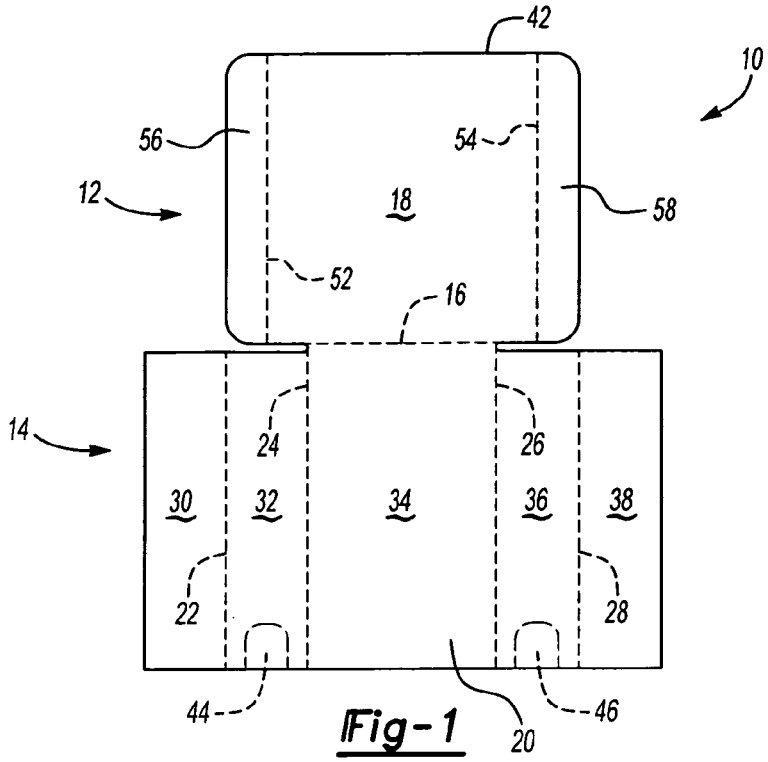
FIG. 1 is a top view of a foldable member according to the exemplary embodiment of the invention.

Referring now to FIG. 1, a foldable member 10 includes a first or bottom portion 12 and a second or side portion 14. A primary fold line 16 is disposed between the first and second portions 12, 14. The first portion 12 includes an upwardly facing surface 18. The second portion 14 includes an inwardly facing surface 20. When the first and second portions 12 and 14 are folded relative to one another along the fold line 16, the surfaces 18 and 20 are generally perpendicular and substantially facing one another, best shown in FIG. 2. In alternative embodiments of the invention, a foldable member could be formed with a single second portion (similar to first portion 14) and pair of first portions (similar to first portion 12) disposed on opposite sides of the single second portion.

The second portion 14 includes a plurality of secondary fold lines 22, 24, 26, 28. The second portion 14 is folded about the plurality of fold lines 22, 24, 26, 28 to define wall sections 30, 32, 34, 36, 38. The wall sections 30, 32, 34, 36, 38 form one-half of a reusable bulk container 40. One of the wall sections, a first wall section 34 in the exemplary embodiment of the invention, is pivotally connected to the bottom portion 12 along the primary fold line 16. A second wall section 32 is connected to the first wall section 34 along a secondary fold line 24. A third wall section 36 is connected to the first wall section 34 opposite the second wall section along a secondary fold line 26. A fourth wall section 30 is connected to the second wall section 32 opposite the first wall section 34 along a secondary fold line 22. The second portion 14 stands upright in the container 40 and the first portion 12 defines the bottom of the container 40.

Figure 2:
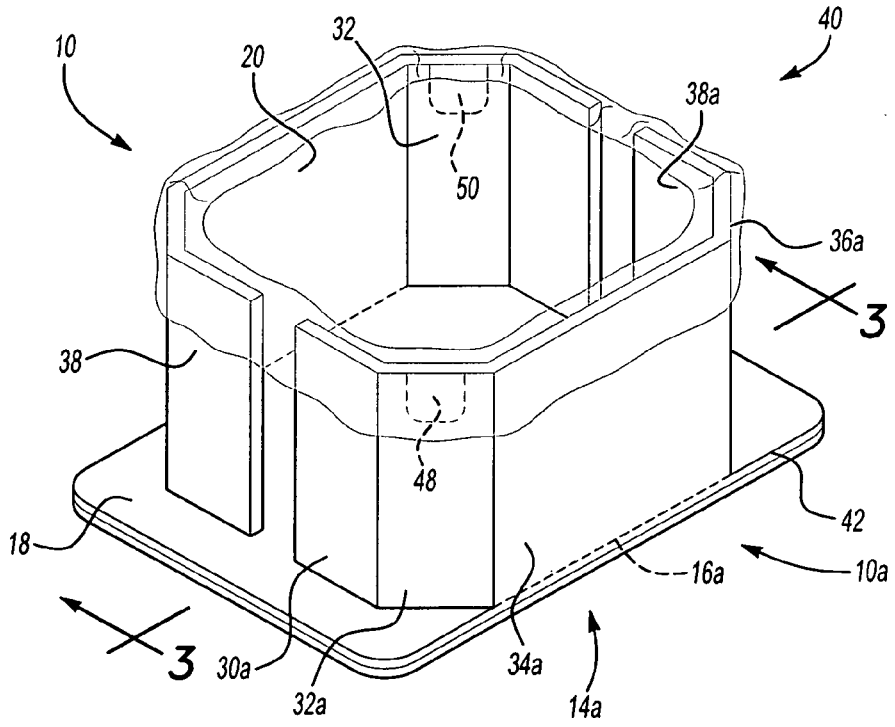
FIG. 2 is a perspective view of a first and second foldable members engaged with one another to form a reusable bulk container according to the exemplary embodiment of the invention.
Figure 3:
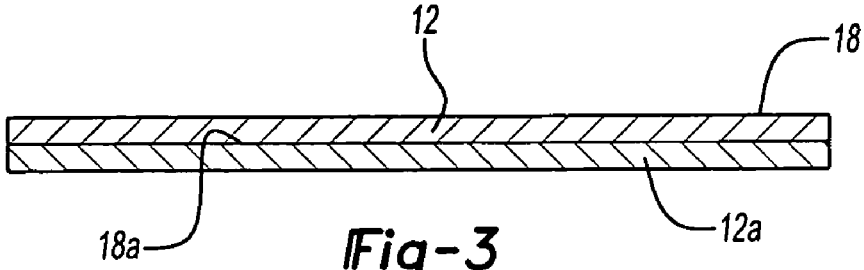
FIG. 3 is a cross-sectional view taken along section lines 3-3 in FIG. 2.

Referring now to FIGS. 2 and 3, the container 40 includes the foldable member 10 and a second foldable member 10*a*. The second foldable member 10*a* is formed substantially similar as the first foldable member 10. For example, the second foldable member 10*a* includes a first portion 12*a* with an upwardly facing surface 18*a*, a second fold line 16*a*, and a second portion having wall sections such as wall section 34*a*. The wall sections of the first and second foldable members 10, 10*a* cooperate to form a frame-like structure for supporting a radially flexible container such as a bag (shown in phantom). Products in bulk can be moved to the bag. When the first and second foldable members 10, 10*a* are engaged with respect to one another, the first portion 12 of the first foldable member 10 is disposed between the wall sections 30*a*, 32*a*, 36*a*, 38*a* and the first portion 12*a* of the second foldable member 10*a*. Also, an edge 42 of the first portion 12 contacts the second foldable member 10*a* adjacent to the fold line 16*a*. In alternative embodiments of the invention, a container such as container 40 could be formed from one foldable member or from more than two foldable members. An alternative container could be formed from the alternative foldable member having two first portions, such as described above. An alternative container could also be formed from more than two foldable members wherein adjacent foldable members are engaged with respect to one another with mating tabs and notches, tape, or any other type of connection structure known in the art.

After the first and second foldable members 10, 10*a* have been engaged with respect to one another, a flexible container such as a bag can be positioned between the respective second portions 14, 14*a*. In at least some embodiments of the invention, the first and second foldable members 10, 10*a*, reduce the cost associated with filling the bag by eliminating the need for complex mechanical strucuture for holding the bag in place during filling. The bag can be filled with particulate material or liquids, such as syrups, fruit fillings, honey, oil, tar or cold patch. The bag (shown in phantom in FIG. 2) can be folded over the side sections 14, 14*a*. For example, the opening of the bag can be extended around and supported by the wall sections 30, 32, 34, 36, 38, 30*a*, 32*a*, 34*a*, 36*a*, 38*a*. The wall sections 30, 32, 34, 36, 38 are transverse to one another to correspond generally to a portion of the circumference of the bag. Likewise, the wall sections 30*a*, 32*a*, 34*a*, 36*a*, 38*a* are similarly transverse to one another. The wall sections 30-30*a*, 32-32*a*, 34-34*a*, 36-36*a*, 38-38*a* are mirrored with respect to each other to substantially encircle the bag. The bag can receive a quantity of product in bulk form. After the bag has been filled to the extent desired, the top of the bag can be drawn over one wall section and the container 40 wrapped in stretch wrap to maintain the bag in a closed orientation.

In another aspect of the exemplary embodiment of the invention, the container 40 and bag could be wrapped in accordance with the teachings of U.S. Pat. No. 6,494,324, which is incorporated by reference. The '324 patent discloses transportable container and a method for forming the container. The container 40 and bag can be wrapped during filling, the level of wrap following the fill level as the fill level rises during filling. Alternatively, the container and bag can be processed according to one or more of the disclosures of U.S. Pat. Nos. 6,892,768; 6,918,225; 6,935,385; and 6,945,015, as well as application Ser. No. 10/280,969, which are hereby incorporated by reference.

In another aspect of the exemplary embodiment of the invention, the wall sections 32, 36, 32*a*, 36*a* include punch-out portions 44, 46, 48, 50, respectively. The punch-out portions 44, 46, 48, 50 can be removed from the respective wall sections 32, 36, 32*a*, 36*a* and receive a handle from another container, such as a sack. The handles of the sack can extend through the openings defined when the punch-out portions 44, 46, 48, 50 are removed or folded out of alignment with the respective wall sections 32, 36, 32*a*, 36*a*. After the sack has been placed between the two second portions 14, 14*a*, the sack and second portions 14, 14*a* can be wrapped with stretch wrap. Alternatively, the punch out portions 44, 46, 48, 50 can remain at least partially connected to the side sections 14, 14*a* and retain a bag in place prior to filling.

In another aspect of the exemplary embodiment of the invention, the first portion 12 defines first and second tab lines 52, 54 and tabs 56, 58. In operation, a handling device for handling the container 40 can engage one or both of the tabs 56, 58 to move the container 40.

The exemplary embodiment of the invention could also include a frame (not shown) to support the bag during filling. The frame could be relatively light weight and formed from relatively small diameter rod. The frame would be shaped to correspond to the interior of the container 40 and would be removable after the bag is filled and wrapped.

Figure 4:
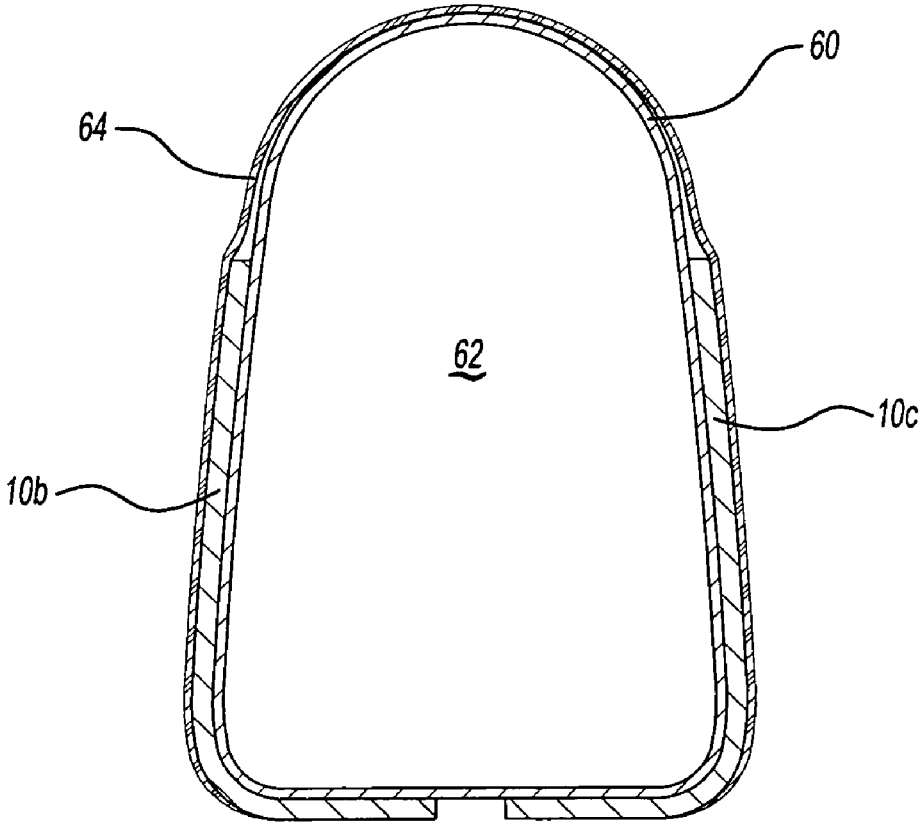
FIG. 4 is a cross-sectional view of a container formed according to one embodiment of the invention.

FIG. 4 shows an alternative embodiment of the invention. A bag 60 has been filled with a mass of material 62. The material 62 can be liquid or can be a plurality of discrete particles. Prior to filing, the bag 60 was placed on, and folded over, first and second foldable members 10*b*, 10*c*. The first and second foldable members 10*b*, 10*c* supported the bag 60 in a desired position during filling. The first and second foldable members 10*b*, 10*c* do not overlap one another, as was shown with respect to the bottom portions 12, 12*a*, of the first and second foldable members 10, 10*a*, in FIGS. 1-3. During filling, the bag 60 was wrapped with wrap 64 to reduce the diameter of the bag 60. The wrap 64 was applied substantially at the fill level of the bag 60 as the fill level rose. The first and second foldable members 10*b*, 10*c* were compressed with the bag 60 during wrapping.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A bulk packaging support structure for supporting a radially flexible container during filling comprising:

a first foldable member;

a second foldable member for releasibly engaging said first foldable member to form the support structure, each of said first and second foldable members including a bottom portion having an upwardly facing surface and a side portion directly connected to said bottom portion along a primary fold line;

each of said side portions of said first and second foldable members including a first wall section extending between a top and a bottom and being directly connected to and disposed substantially perpendicular to said bottom portion along said primary fold line and wherein said first wall section of said first foldable member and said first wall section of said second foldable member are spaced and parallel to one another, a second wall section extending between a top and a bottom and being directly connected to said first wall section along a secondary fold line extending between the top and bottom and perpendicular to said primary fold line, said second wall section being moveable about said secondary fold line for substantially encircling the radially flexible container;

said upwardly facing surface of said second foldable member and the bottom of said second wall section of said second foldable member defining a gap for receiving said bottom portion of said first foldable member to form the support structure and wherein the bottom of said second wall section of said second foldable member is movable over said upwardly facing surface of said first foldable member for substantially encircling the radially flexible container.

2. The bulk packaging support structure as set forth in claim 1 wherein said upwardly facing surface of said bottom portion of said first foldable member defines an edge disposed opposite said primary fold line of said first foldable member and said edge of said bottom portion of said first foldable member contacts said second foldable member adjacent said primary fold line of said second foldable member.

3. The bulk packaging support structure as set forth in claim 1 wherein each of said side portions further include a third wall section extending between a top and a bottom and being directly connected to said first wall section opposite said second wall section along a secondary fold line extending between the top and bottom and perpendicular to said primary fold line, said third wall section being moveable about said secondary fold line for substantially encircling the radially flexible container.

4. The bulk packaging support structure as set forth in claim 3 wherein said gap for receiving said bottom portion of said first foldable member is further defined by said upwardly facing surface of said second foldable member and the bottom of said third wall section of said second foldable member and wherein the bottom of said third wall section of said second foldable member is movable over said upwardly facing surface of said first foldable member for substantially encircling the radially flexible container.

5. The bulk packaging support structure as set forth in claim 3 wherein each of said side portions further include a fourth wall section extending between a top and a bottom and being directly connected to said second wall section opposite said first wall section along a secondary fold line extending between the top and bottom and perpendicular to said primary fold line, said fourth wall section being moveable about said secondary fold line for substantially encircling the radially flexible container.

6. The bulk packaging support structure as set forth in claim 5 wherein said gap for receiving said bottom portion of said first foldable member is further defined by said upwardly facing surface of said second foldable member and the bottom of said fourth wall section of said second foldable member and wherein the bottom of said fourth wall section of said second foldable member is movable over said upwardly facing surface of said first foldable member for substantially encircling the radially flexible container.

7. The bulk packaging support structure as set forth in claim 5 wherein each of said side portions further include a fifth wall section extending between a top and a bottom and being directly connected to said third wall section opposite said first wall section along a secondary fold line extending between the top and bottom and perpendicular to said primary fold line, said fifth wall section being moveable about said secondary fold line for substantially encircling the radially flexible container.

8. The bulk packaging support structure as set forth in claim 7 wherein said gap for receiving said bottom portion of said first foldable member is further defined by said upwardly facing surface of said second foldable member and the bottom of said fifth wall section of said second foldable member and wherein the bottom of said fifth wall section of said second foldable member is movable over said upwardly facing surface of said first foldable member for substantially encircling the radially flexible container.

9. The bulk packaging support structure as set forth in claim 7 further including punch-out portions defined in at least one of said first, second, third, fourth and fifth wall sections of said first and second foldable members for retaining the radially flexible container.

10. The bulk packaging support structure as set forth in claim 1 further including first and second tabs pivotally connected to said bottom portion of said second foldable member along first and second tab lines for extending perpendicular to said primary fold line to assist in the handling of the support structure.

11. The bulk packaging support structure as set forth in claim 1 wherein said first and second foldable members are paperboard.

12. The bulk packaging support structure as set forth in claim 1 wherein said first and second foldable members have a same shape.

13. The bulk packaging support structure as set forth in claim 1 wherein said bottom and side portions of said first and second foldable members are generally rectangular.

14. A foldable member for a bulk packaging support structure and supporting a radially flexible container during filling comprising:

a foldable member including a bottom portion having an upwardly facing surface and a side portion directly connected to said bottom portion along a primary fold line;

said side portion including a first wall section extending between a top and a bottom and being directly connected to said bottom portion along said primary fold line, a second wall section extending between a top and a bottom and being directly connected to said first wall section along a secondary fold line extending between the top and bottom and perpendicular to said primary fold line, said second wall section being moveable about said secondary fold line for substantially encircling the radially flexible container;

said bottom portion of said foldable member and the bottom of said second wall section of said foldable member defining a gap capable of receiving a bottom portion of a second foldable member.

15. The bulk packaging support structure as set forth in claim 14 wherein said side portion further includes a third wall section extending between a top and a bottom and being directly connected to said first wall section opposite said second wall section along a secondary fold line extending between the top and bottom and perpendicular to said primary fold line, said third wall section being moveable about said secondary fold line for substantially encircling the radially flexible container.

16. The bulk packaging support structure as set forth in claim 15 wherein said gap being capable of receiving the bottom portion of the second foldable member is further defined by said bottom portion of said foldable member and the bottom of said third wall section of said foldable member.

17. The bulk packaging support structure as set forth in claim 15 wherein said side portion further includes a fourth wall section extending between a top and a bottom and being directly connected to said second wall section opposite said first wall section along a secondary fold line extending between the top and bottom and perpendicular to said primary fold line, said fourth wall section being moveable about said secondary fold line for substantially encircling the radially flexible container.

18. The bulk packaging support structure as set forth in claim 17 wherein said gap being capable of receiving the bottom portion of the second foldable member is further defined by said bottom portion of said foldable member and the bottom of said fourth wall section of said foldable member.

19. The bulk packaging support structure as set forth in claim 17 wherein said side portion further includes a fifth wall section extending between a top and a bottom and being directly connected to said third wall section opposite said first wall section along a secondary fold line extending between the top and bottom and perpendicular to said primary fold line, said fifth wall section being moveable about said secondary fold line for substantially encircling the radially flexible container.

20. The bulk packaging support structure as set forth in claim 19 wherein said gap being capable of receiving the bottom portion of the second foldable member is further defined by said bottom portion of said foldable member and the bottom of said fifth wall section of said foldable member.

* * * * *